US008933356B2

(12) United States Patent
Koike

(10) Patent No.: US 8,933,356 B2
(45) Date of Patent: Jan. 13, 2015

(54) SWITCH DEVICE

(75) Inventor: Syuichi Koike, Sagamihara (JP)

(73) Assignee: Nifco Inc., Yokohama-shi, Kanagawa (JP)

( * ) Notice: Subject to any disclaimer, the term of this patent is extended or adjusted under 35 U.S.C. 154(b) by 443 days.

(21) Appl. No.: 13/202,433

(22) PCT Filed: Feb. 15, 2010

(86) PCT No.: PCT/JP2010/052196

§ 371 (c)(1),
(2), (4) Date: Oct. 3, 2011

(87) PCT Pub. No.: WO2010/095595

PCT Pub. Date: Aug. 26, 2010

(65) Prior Publication Data

US 2012/0037483 A1 Feb. 16, 2012

(30) Foreign Application Priority Data

Feb. 19, 2009 (JP) ..... 2009-037200

(51) Int. Cl.

| | |
|---|---|
| ***H01H 3/42*** | (2006.01) |
| ***H01H 13/56*** | (2006.01) |
| ***H01H 27/00*** | (2006.01) |
| ***E05C 19/02*** | (2006.01) |

(52) U.S. Cl.

CPC ..... *H01H 13/562* (2013.01); *H01H 27/00* (2013.01); *E05C 19/022* (2013.01)

USPC ..... 200/524

(58) Field of Classification Search

CPC ..... H01H 13/12; H01H 13/14; H01H 13/50; H01H 13/562; H01H 27/00

USPC ..... 200/524

See application file for complete search history.

(56) References Cited

U.S. PATENT DOCUMENTS 5,821,490 A * 10/1998 Blossfeld ..... 200/524
6,028,274 A * 2/2000 Harris ..... 200/524

(Continued)

FOREIGN PATENT DOCUMENTS

JP U-S56-153040 11/1981
JP U-H05-45853 6/1993

(Continued)

OTHER PUBLICATIONS

Japan Patent Office, "Office Action for JP 2009-037200", Oct. 9, 2012.

Chinese Patent Office, "Office Action for CN 201080008360.6", Jul. 16, 2013.

Europe Patent Office, "European Search Report for EP 10743721.2," Apr. 22, 2014.

*Primary Examiner* — Renee Luebke
*Assistant Examiner* — Lheiren Mae Caroc
(74) *Attorney, Agent, or Firm* — Manabu Kanesaka

(57) ABSTRACT

In a state wherein a striker (88) is not locked in a latch (90), a movable terminal (74) of a spring terminal (70) is in contact with a fixed terminal (54) of a terminal base (14). Namely, a micro switch is turned ON. Here, the movable terminal (74) is folded outwardly, and includes a leaf spring function. Further, in an end portion of the movable terminal (74), a hemispherical contact portion (74A) protrudes outwardly, and the contact portion (74A) contacts a contact portion (54A) of the fixed terminal (54). Thus, in a state wherein the contact portion (74A) is in contact with the contact portion (54A), elastic energy is accumulated in the movable terminal (74).

11 Claims, 8 Drawing Sheets

(56) References Cited

U.S. PATENT DOCUMENTS

| | | | |
|---|---|---|---|
| 2003/0173202 | A1 | 9/2003 | Yamaguchi et al. |
| 2004/0075281 | A1 | 4/2004 | Ueki |
| 2004/0169377 | A1 | 9/2004 | Kawamoto et al. |
| 2005/0082153 | A1 | 4/2005 | Ichimaru |

FOREIGN PATENT DOCUMENTS

| | | | |
|---|---|---|---|
| JP | 2003-272476 | A | 9/2003 |
| JP | 2005-129248 | A | 5/2005 |
| JP | 2008-117684 | | 5/2008 |

* cited by examiner

SWITCH DEVICE

RELATED APPLICATIONS

The present application is National Phase of International Application No. PCT/JP2010/052196 filed Feb. 15, 2010, and claims priority from, Japanese Application no. 2009-037200, filed Feb. 19, 2009.

FIELD OF TECHNOLOGY

The present invention relates to a switch device.

BACKGROUND ART

A switch device is provided in an accessory, audio equipment, and the like inside a vehicle such as a cup holder, ashtray, and the like. For example, in Patent Document 1, a latch with a switch is disclosed, and a movable member urged by a coil spring and positioned in a protruding position is pushed into a housing, so that a lock mechanism comes to a lock state so as to lock the movable member in a push-in position.

Then, in this state, a micro switch is turned OFF, and by pushing the movable member in the push-in position into the housing again, the lock state of the lock mechanism is released, and the movable member returns to the protruding position, and also the micro switch is turned ON.

In the latch with the switch, the micro switch comprises a pin attached to the movable member, and a pair of fixed terminals fixed into the housing, coming to a conduction state by contacting both end portions of the pin at the protruding position of the movable member, and coming to a non-conduction state by not contacting the both end portions of the pin at the push-in position of the movable member. In the fixed terminals, a terminal hole is formed, and the pin is allowed to be inserted into the terminal hole.

When the movable member reaches the protruding position, an end portion of the terminal hole contacts the pin so as to become the conduction state. However, the width of the terminal hole is made larger than an external diameter of the pin, and the end portion of the terminal hole is made approximately the same as the external diameter size of the pin.

PRIOR ART DOCUMENT

Patent Document

Patent Document 1: Japanese Unexamined Patent Publication No. 2005-42428

SUMMARY OF THE INVENTION

Problems to be Solved by the Invention

The present invention provides a switch device which can reliably contact a movable terminal and a fixed terminal in view of the above-mentioned fact.

Means for Solving the Problems

In a first aspect of the present invention, a switch device comprises a moving member provided so as to be capable of protruding from a housing; a latch member provided in the above-mentioned moving member, and engaging a striker; an urging member urging the above-mentioned moving member in a direction protruding from the above-mentioned housing;

a lock mechanism locking the above-mentioned moving member relative to the above-mentioned housing so as to be incapable of moving in a state wherein an urging force is accumulated in the above-mentioned urging member, and releasing a lock state of the moving member when the moving member is pushed into the housing in a state wherein the moving member is locked in the housing; a movable terminal provided in the above-mentioned moving member; and a fixed terminal provided in a fixed member fixed inside the above-mentioned housing, wherein the above-mentioned movable terminal contacts and conducts in the lock state of the above-mentioned moving member, and wherein the movable terminal does not contact and does not conduct in an unlock state of the moving member. In the switch device, in a state wherein elastic energy is accumulated at least in the movable terminal or the fixed terminal, the above-mentioned movable terminal and the above-mentioned fixed terminal are contacted.

In the above-mentioned aspect, the moving member is allowed to protrude from the housing, and in the moving member, the latch member engaging the striker is provided. Here, the urging member urging the moving member in the direction protruding from the housing is provided. In a state wherein the urging force is accumulated in the urging member, the moving member is locked relative to the housing so as to be incapable of moving, and in the state wherein the moving member is locked in the housing, when the moving member is pushed into the housing, the lock state of the moving member is released.

Also, the movable terminal is provided in the moving member, and the fixed terminal provided in the fixed member fixed inside the housing is allowed to contact. Then, in the lock state of the moving member, the movable terminal contacts the fixed terminal so as to be conducted, and in the unlock state of the moving member, the movable terminal does not contact relative to the fixed terminal so as to be not conducted.

Here, in the state wherein the elastic energy is accumulated at least in the movable terminal or the fixed terminal, the movable terminal and the fixed terminal are contacted. Thereby, when comparing a case where only the movable terminal and the fixed terminal are contacted, a contact force between the movable terminal and the fixed terminal improves. Namely, the movable terminal and the fixed terminal can be reliably contacted (conducted).

As for a second aspect of the present invention, in the first aspect of the present invention, the above-mentioned latch member may be rotatably supported in the above-mentioned moving member, and a cam mechanism, allowing a movement amount of the moving member to be converted to a rotational force of the above-mentioned latch member, may be provided inside the above-mentioned housing.

According to the above-mentioned aspect, the latch member is rotatably supported in the moving member, and due to the cam mechanism provided inside the above-mentioned housing, the movement amount of the moving member can be converted to the rotational force of a latch portion.

As for a third aspect of the present invention, in the first aspect of the present invention, a fixation mechanism fixing the above-mentioned fixed member may be provided in the above-mentioned housing.

According to the above-mentioned aspect, by providing the fixation mechanism fixing the fixed member in the housing, the fixed member can be positioned relative to the housing.

As for a fourth aspect of the present invention, in the third aspect of the present invention, the above-mentioned fixation mechanism may be structured by including an opening provided in the above-mentioned housing, and a projection portion provided in the above-mentioned fixed member, entered into the above-mentioned opening, and locked in an opening border portion of the opening.

In the above-mentioned aspect, the opening is provided in the housing. In the fixed member, the projection portion is provided, and when the fixed member is inserted into the housing, and the projection portion enters into the opening and is engaged with the opening border portion of the opening, the fixed member is fixed in the housing. Herewith, since the projection portion is exposed from the opening of the housing, whether or not the fixed member is reliably fixed in the housing can be visually confirmed.

As for a fifth aspect of the present invention, in the first aspect of the present invention, the above-mentioned lock mechanism may be structured by including a circulation cam groove formed in the above-mentioned moving member, and a guide member provided in the above-mentioned housing so as to be capable of swaying, circulating along the above-mentioned circulation cam groove, and locking the above-mentioned moving member in a state locked in a locking portion provided in the circulation cam groove.

In the above-mentioned embodiment, the lock mechanism comprises the circulation cam groove formed in the moving member, and in the housing, the guide member is provided so as to be capable of swaying. Then, due to a movement of the moving member, the guide member circulates along the circulation cam groove, and in the state wherein the guide member is locked in the locking portion provided in the circulation cam groove, the moving member is locked.

As for a sixth aspect of the present invention, in the first aspect of the present invention, the above-mentioned lock mechanism is structured by including the circulation cam groove formed in the above-mentioned housing, and the guide member provided in the above-mentioned moving member so as to be capable of swaying, circulating along the above-mentioned circulation cam groove, and locking the above-mentioned moving member in the state locked in the locking portion provided in the circulation cam groove.

In the above-mentioned aspect, the circulation cam groove is formed in the housing, and in the moving member, the guide member is provided so as to be capable of swaying. Then, due to the movement of the moving member, the guide member circulates along the circulation cam groove, and in the state wherein the guide member is locked in the locking portion provided in the circulation cam groove, the moving member is locked.

As for a seventh aspect of the present invention, in the first aspect of the present invention, the above-mentioned fixed terminal is formed in the above-mentioned fixed member by insert molding.

According to the above-mentioned aspect, by forming the fixed terminal in the fixed member by the insert molding, an operation for mounting the fixed terminal on the fixed member can be omitted, so that operational steps can be reduced.

As for an eighth aspect of the present invention, the switch device comprises the moving member provided so as to be capable of protruding from the housing; the latch member provided in the above-mentioned moving member, and engaging the striker; the urging member urging the above-mentioned moving member in the direction protruding from the above-mentioned housing; the lock mechanism locking the above-mentioned moving member relative to the above-mentioned housing so as to be incapable of moving in the state wherein the urging force is accumulated in the above-mentioned urging member, and when the moving member is pushed into the housing in the state wherein the moving member is locked in the housing, the lock state of the moving member is released; the movable terminal provided in the above-mentioned moving member; and the fixed terminal provided in the fixed member fixed in the inside of the above-mentioned housing. The above-mentioned movable terminal contacts and conducts in the unlock state of the above-mentioned moving member, and the movable terminal does not contact and does not conduct in the lock state of the moving member. In the switch device, in the state wherein the elastic energy is accumulated at least in the movable terminal or the fixed terminal, the above-mentioned movable terminal and the above-mentioned fixed terminal are contacted.

In the above-mentioned aspect, in the unlock state of the moving member, the movable terminal contacts the fixed terminal so as to be conducted, and in the lock state of the moving member, the movable terminal does not contact relative to the fixed terminal so as not to be conducted. However, the approximately same effect as an effect of the first aspect of the present invention can be obtained.

As for a ninth aspect of the present invention, in the eighth aspect of the present invention, the above-mentioned latch member is rotatably supported in the above-mentioned moving member, and the cam mechanism, allowing the movement amount of the moving member to be converted to the rotational force of the above-mentioned latch portion, may be provided inside the above-mentioned housing.

According to the above-mentioned aspect, the latch member is rotatably supported in the moving member, and by the cam mechanism provided inside the above-mentioned housing, the movement amount of the moving member can be converted to the rotational force of the latch portion.

As for a tenth aspect of the present invention, in the eighth aspect of the present invention, the fixation mechanism fixing the above-mentioned fixed member may be provided in the above-mentioned housing.

According to the above-mentioned aspect, by providing the fixation mechanism fixing the fixed member in the housing, the fixed member can be positioned relative to the housing.

As for an eleventh aspect of the present invention, in the tenth aspect of the present invention, the above-mentioned fixation mechanism may be structured by including the opening provided in the above-mentioned housing, and the projection portion provided in the above-mentioned fixed member, entered into the above-mentioned opening, and locked in the opening border portion of the opening.

In the above-mentioned aspect, the opening is provided in the housing. In the fixed member, the projection portion is provided, and when the fixed member is inserted into the housing, and the projection portion is entered into the opening, and locked in the opening border portion of the opening, the fixed member is fixed in the housing. Herewith, since the projection portion is exposed from the opening of the housing, whether or not the fixed member is reliably fixed in the housing can be visually confirmed.

As for a twelfth aspect of the present invention, in the first aspect of the present invention, the above-mentioned lock mechanism may be structured by including the circulation cam groove formed in the above-mentioned moving member, and the guide member provided in the above-mentioned housing so as to be capable of swaying, circulating along the above-mentioned circulation cam groove, and locking the above-mentioned moving member in the state locked in the locking portion provided in the circulation cam groove.

In the above-mentioned embodiment, the lock mechanism comprises the circulation cam groove formed in the moving member, and the guide member is provided in the housing so as to be capable of swaying. Then, due to the movement of the moving member, the guide member circulates along the circulation cam groove, and in the state wherein the guide member is locked in the locking portion provided in the circulation cam groove, the moving member is locked.

As for a thirteenth aspect of the present invention, in the first aspect of the present invention, the above-mentioned lock mechanism is structured by including the circulation cam groove formed in the above-mentioned housing, and the guide member provided in the above-mentioned moving member so as to be capable of swaying, circulating along the above-mentioned circulation cam groove, and locking the above-mentioned moving member in the state locked in the locking portion provided in the circulation cam groove.

In the above-mentioned aspect, the circulation cam groove is formed in the housing, and the guide member is provided in the moving member so as to be capable of swaying. Then, by the movement of the moving member, the guide member circulates along the circulation cam groove, and in the state wherein the guide member is locked in the locking portion provided in the circulation cam groove, the moving member is locked.

As for a fourteenth aspect of the present invention, in the first aspect of the present invention, the above-mentioned fixed terminal is formed in the above-mentioned fixed member by the insert molding.

According to the above-mentioned aspect, by forming the fixed terminal in the fixed member by the insert molding, the operation for mounting the fixed terminal on the fixed member can be omitted, so that the operational can be reduced.

Effect of the Invention

Since the present invention is made by the above-mentioned structure, the movable terminal and the fixed terminal can be reliably contacted.

BEST MODES OF CARRYING OUT THE INVENTION

Next, a switch device according to an embodiment of the present invention will be explained.

Figure 1:
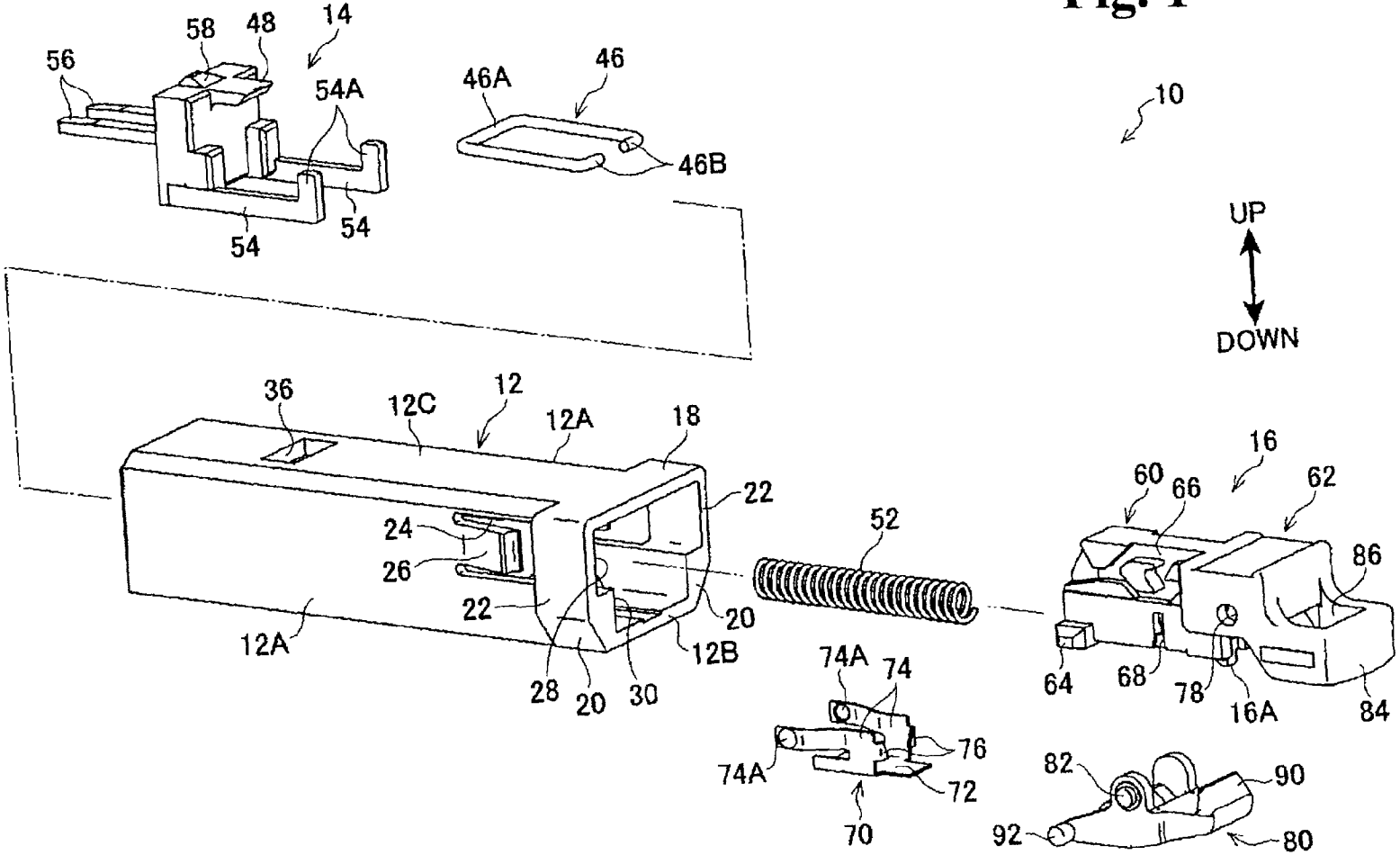
FIG. 1 is an exploded perspective view showing a switch device according to an embodiment of the present invention.

As shown in FIG. 1, a switch device 10 comprises a housing 12, and a terminal base (fixed member) 14 and a slider (moving member) 16, and the like can be housed inside the housing 12.

(Housing)

First, the housing 12 will be explained.

As shown in FIG. 1, in the switch device 10, the housing forming an angle tube shape is provided. Here, for the sake of convenience for explanation, an arrow UP in FIG. 1 shows an upside of the housing 12, and an arrow DOWN shows a downside of the housing 12.

On one end side (a right side in FIG. 1) of a longitudinal direction of the housing 12, a flange 18 extending from side walls 12A of the housing 12 is provided. The flange 18 is structured by slope portions 20 provided on a lower wall 12B side of the housing 12, and straight-line portions 22 connected to the slope portions 20 and formed in parallel with the side walls 12A of the housing 12.

Figure 2:
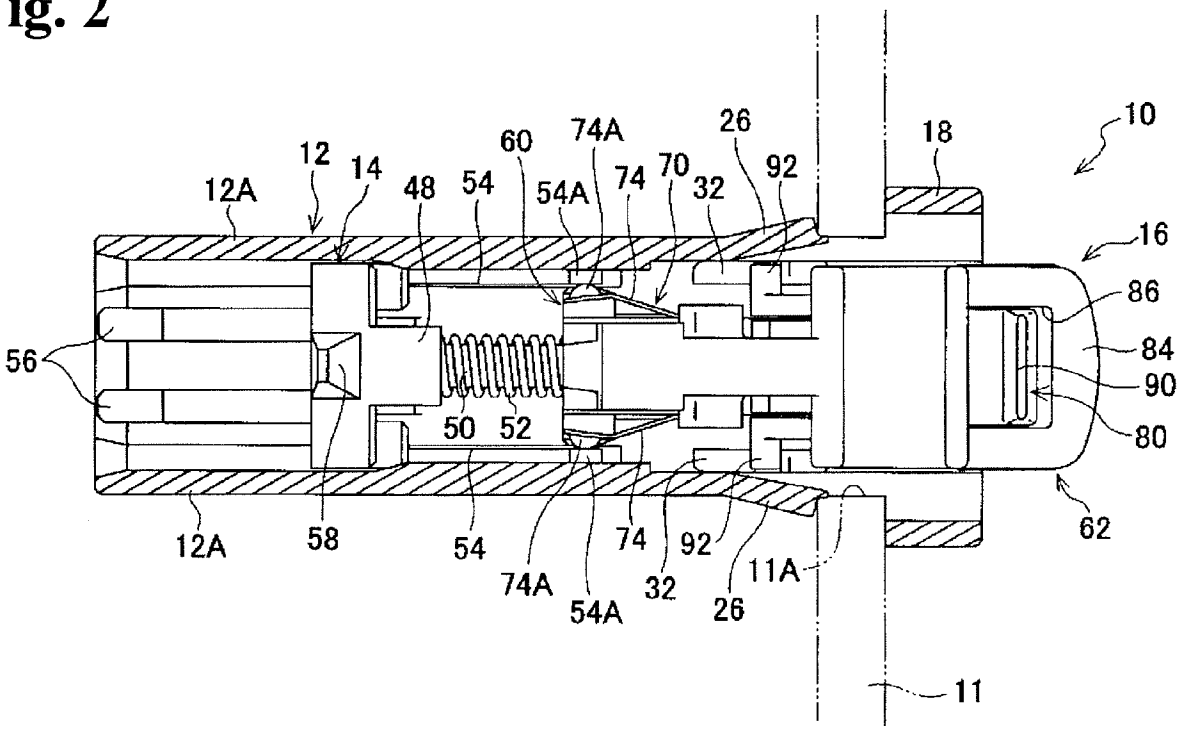
FIG. 2 is a transverse cross-sectional view of the switch device according to the embodiment of the present invention, and shows only the switch device in a state wherein a striker is not locked in the switch device.

Near the straight-line portions 22, through holes 24 are formed along the longitudinal direction of the housing 12, and inside the through holes 24, locking pieces 26 extending to a straight-line portion 22 side are provided. As shown in FIG. 2 (incidentally, FIG. 2 is a transverse cross-sectional view of the switch device 10), the locking pieces 26 protrude toward an outside as the locking pieces 26 go to an end side, and by clamping a peripheral border portion of an attachment hole 11A formed in a frame 11 between the flange 18, the housing 12 can be attached to the frame 11.

Figure 3:
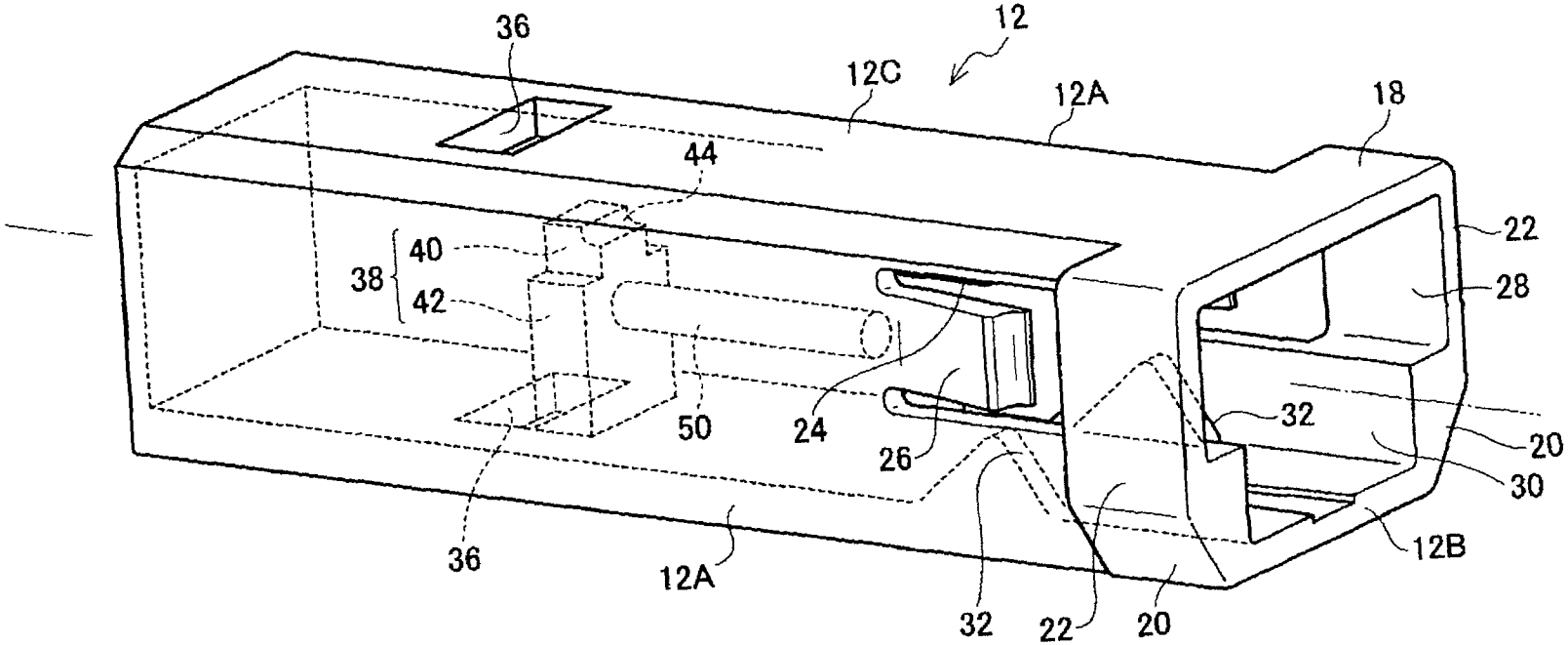
FIG. 3 is a perspective view showing a housing of the switch device according to the embodiment of the present invention.

On the other hand, as shown in FIG. 1, in the straight-line portions 22 of the flange 18, for a portion protruding to the outside of the side walls 12A of the housing 12, inner walls of the straight-line portions 22 extend to an outside rather than inner walls of the slope portions 20. On one end portion of the housing 12, an opening 28 on an upper wall 12C side of the housing 12 has a width wider than an opening 30 on the lower wall 12B side. Consequently, when a slider 16 is housed inside the housing 12, a reverse insertion in an up-and-down direction of the slider 16 is prevented. Here, as shown in FIG. 3, on an inside of the side walls 12A on one end side of the housing 12, cam slope faces (cam mechanisms) 32 forming a triangle shape are formed as described hereinafter.

Also, on the upper wall 12C and the lower wall 12B on the other end side of the housing 12, short-shaped holes (opening) 36 pass through along a width direction of the housing 12. Then, inside the housing 12, a stopper 38 is provided near an opening border portion positioned on a flange 18 side of the short-shaped hole 36.

The stopper 38 comprises a neck portion 40 and a torso portion 42 forming a cuboid shape. In an upper end portion of the neck portion 40, on a face at an opposite side of the short-shaped hole 36, an engaging depressed portion 44 is provided, and a base portion 46A of a lever (guide member) 46 (see FIG. 1) forming an approximately U shape is allowed to be engaged.

Figure 4:
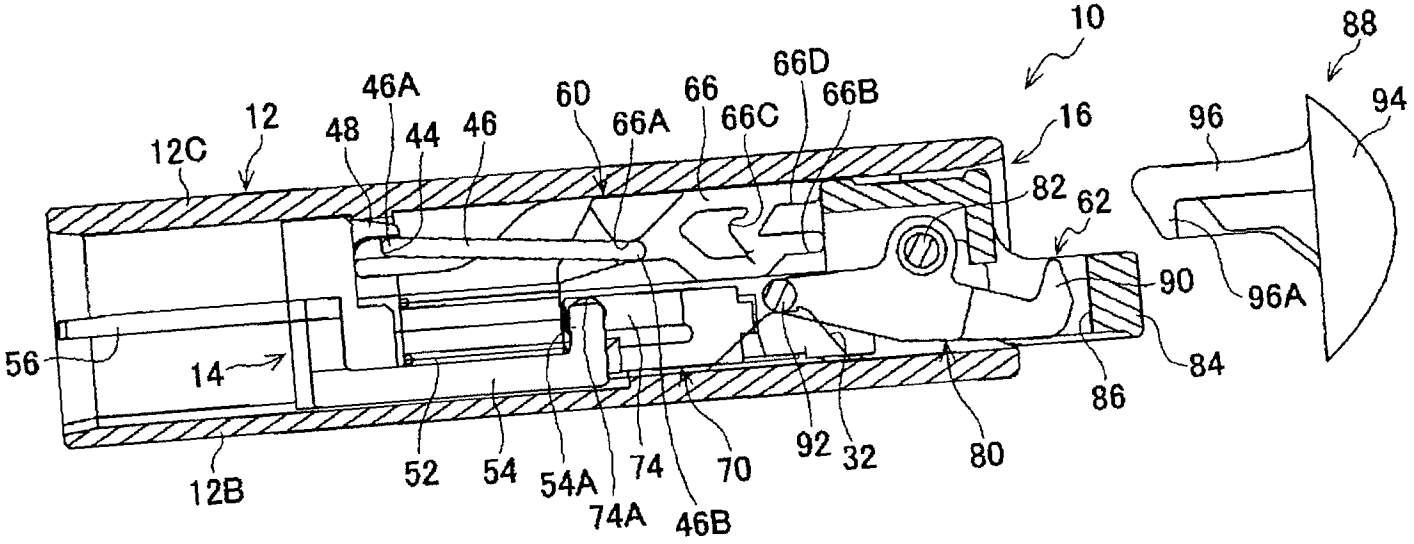
FIG. 4 is a longitudinal cross-sectional view of the switch device according to the embodiment of the present invention, and shows a state wherein the striker is not locked in the switch device.

Then, the base portion 46A of the lever 46 is retained between an extending piece 48 (see FIG. 1) of the after-mentioned terminal base 14 and the engaging depressed portion 44 (see FIG. 4; incidentally, FIG. 4 is a longitudinal cross-sectional view of the switch device). Thereby, the lever 46 is allowed to sway along the up-and-down direction at a center of the base portion 46A.

On the other hand, in a center portion of the face on the opposite side of the short-shaped hole 36 of the torso portion 42, a bar-like mounting portion 50 projecting along the longitudinal direction of the housing 12 is provided. In the mounting portion 50, a coil spring (urging member) 52 (see FIG. 1) is mounted. Incidentally, from both side walls of the neck portion 40, arm portions (not shown in the figures) extending to the upper wall of the housing 12 are provided after the arm portions are extended along the width direction of the housing 12.

Also, a gap is provided respectively between an upper surface of the neck portion 40 of the stopper 38 and the upper wall 12C of the housing 12, and between the torso portion 42 and the side walls 12A of the housing 12. The extending piece 48 of the after-mentioned terminal base 14 and fixed terminals 54 are allowed to be inserted through the respective gap.

(Terminal Base)

Next, the terminal base will be explained.

As shown in FIGS. 1 and 3, the terminal base 14 forms an approximately cuboid shape, and is allowed to be housed from the other end side (a left side in FIG. 1) of the longitudinal direction of the housing 12. Inside the housing 12, the stopper 38 is provided, so that due to the stopper 38, a movement of the terminal base 14 is controlled.

Here, one end face of the terminal base 14 is positioned in an opening of the housing 12, and from a center portion of one end face, a pair of conductive fixed terminals with a long plate shape is provided along a horizontal direction. The fixed terminals 56 are connected to, for example, a lighting device of LED and the like.

Also, on both end portions of a lower portion of the other end face of the terminal base 14, the conductive fixed terminals 54 with a long plate shape connected to the fixed terminals 56 are respectively provided along the horizontal direction, and are integrally formed with the resin terminal base 14 with the fixed terminals 56 by insert molding. Thereby, an operation for mounting the fixed terminals 54, 56 on the terminal base 14 can be omitted, so that the mounting operation can be reduced.

As mentioned above, the fixed terminals 54 are allowed to be inserted through the gap provided between the side walls 12A of the housing 12 and the torso portion 42 of the stopper 38. On end portions of the fixed terminals 54, contact portions 54A vertically standing upward are provided.

Also, from a center of an upper portion of the other end face of the terminal base 14, the extending piece 48 extends horizontally, and as mentioned above, the extending piece 48 is allowed to be inserted through the gap provided between the upper wall 12C of the housing 12 and the upper surface of the neck portion 40. In a state wherein the extending piece 48 is inserted through the gap, the lever 46 is retained between the extending piece 48 and the engaging depressed portion 44 of the stopper 38 (see FIG. 4).

Moreover, on an upper surface and a lower surface of the terminal base 14, projection portions 58 are provided. The projection portions 58 are allowed to enter into the short-shaped hole 36 provided in the housing 12. The terminal base 14 is pressed into the housing 12 from the other end side of the longitudinal direction of the housing 12, and in a state wherein the terminal base 14 abuts against the stopper 38 so that the movement of the terminal base 14 is controlled, the projection portions 58 enter into the short-shaped hole 36, and are respectively locked in opening border portions of the short-shaped hole 36.

Thereby, the terminal base 14 is fixed in the housing 12. Also, in this state, since the projection portions 58 are exposed from the short-shaped hole 36 of the housing 12, whether or not the terminal base 14 is reliably fixed in the housing 12 can be visually confirmed.

(Slider)

Next, the slider will be explained.

As shown in FIG. 1, the slider 16 forms an approximately cuboid shape, and is allowed to be housed from one end side of the longitudinal direction of the housing 12. The slider 16 is structured by a cam portion 60 and a supporting portion 62, and a cam portion 60 side is housed inside the housing 12.

In a center portion of an end face of the cam portion 60, an approximately cylinder-shaped housing depressed portion (not shown in the figures) is formed along a longitudinal direction of the slider 16, and the other end portion of the coil spring 52 mounted on the mounting portion of the stopper 38 is allowed to be housed. Then, the slider 16 is urged in a direction protruding from the housing 12 by the coil spring 52.

Also, on an upper portion of both side walls of the cam portion 60, an approximately heart-shaped cam groove (circulation cam groove) 66 is formed. Engagement pins 46B, provided in end portions of the lever 46 engaged with the engaging depressed portion 44 of the stopper 38, are respectively engaged with the cam groove 66.

On lower portions of both the side walls of the cam portion 60, approximately cuboid-shaped projection portions 64 are provided on an end face side of the cam portion 60, and near the projection portions 64, a locking hole 68 is formed. Through the locking hole 68, a conductive spring terminal 70 is allowed to be mounted on the lower portion of both the side walls of the cam portion 60.

The spring terminal 70 is structured by a base portion 72 contacted with a lower wall of the cam portion 60 with a surface, and movable terminals 74, folded in such a way as to mutually face surfaces on both sides of the base portion 72. The movable terminals 74 extend along a longitudinal direction of the base portion 72. On a base portion side of the movable terminals 74, mounting pieces 76 are provided, and the mounting pieces 76 are locked in the locking hole 68.

Also, the movable terminals 74 are folded outwardly in a direction being separated from each other, and include a leaf spring function. Further, on outer surfaces of end portions of the movable terminals 74, hemispherical contact portions 74A protrude outwardly.

Also, a separated distance between both outer surfaces of the contact portions 74A is made larger than a separated distance between both inner surfaces of the contact portions 54A of the fixed terminals 54 provided in the terminal base 14, and the contact portions 74A are allowed to face the contact portions 54A face-to-face. Consequently, the contact portions 74A contact the contact portions 54A of the fixed terminals 54 in a state wherein the diameters of the contact portions 74A are reduced. Then, in a state wherein the contact portions 74A contact the contact portions 54A, the contact portions 74A and the contact portions 54A are conducted to each other, so that a micro switch is turned ON.

Here, since the contact portions 54A of the fixed terminals 54 are formed in a state of vertically standing upward in the end portions of the fixed terminals 54, a base portion side of the fixed terminals 54 is out of alignment in a height direction between the contact portions 54A. Therefore, if the contact portions 74A of the movable terminals 74 are out of alignment from a face-to-face position with the contact portions 54A, the contact portions 74A of the movable terminals 74 and the fixed terminals 54 come to a state of not contacting (non-contact state).

On the other hand, the supporting portion 62 has a width wider than the cam portion 60, and the supporting portion 62 is formed so as to cover one portion of the cam portion 60. Then, in an area wherein the supporting portion covers the cam portion 60, a gap is provided in a width direction thereof between the supporting portion 62 and the cam portion 60.

In the supporting portion 62, along a width direction of the slider 16, an axis support hole 78 is formed, and an axis portion 82 provided in a latch member 80 is inserted through the gap provided between the supporting portion 62 and the cam portion 60 so as to be supported by an axis on the axis support hole 78. Thereby, the latch member 80 is allowed to sway relative to the slider 16 at a center of the axis portion 82.

Also, on an end face of the supporting portion 62, a jutting portion 84, whose upper portion is notched so as to be approximately half the height of the cam portion 60, is provided. In the jutting portion 84, a through hole 86 passing through the up-and-down direction thereof is formed, and a latch 90 provided in one end portion of the latch member is allowed to move (sway) up and down inside the through hole 86. Due to the latch 90, a striker 88 (see FIG. 4) is locked.

Also, in the other end portion of the latch member 80, guide portions 92 protruding in the width direction of the cam portion 60 are provided. The guide portions 92 are allowed to abut against the cam slope faces 32 (see FIG. 3) provided on the inside of one end side of the housing 12, and according to the shape of the cam slope faces 32, the latch member 80 sways at the center of the axis portion 82 through the guide portions 92.

Namely, in a state wherein the latch member 80 is supported in the supporting portion 62 of the slider 16 so as to be capable of swaying, due to the cam slope faces 32, a movement amount of the slider 16 can be converted to a rotational force of the latch member 80 through the guide portions 92.

Here, as shown in FIG. 1, at a center on a supporting portion 62 side of a lower surface of the cam portion 60 of the slider 16, a projection 16A is provided, and is allowed to be inserted into an insertion hole (not shown in the figures) provided in a center of the lower wall 12B on one end side of the housing 12. In a state wherein the projection 16A is inserted into the insertion hole, the slider 16 is allowed to move inside the housing 12 within a movement range of the projection 16A. Thereby, the slider 16 is prevented from slipping out of the housing 12 immoderately.

(Operation of Switch Device)

Next, an operation of the switch device according to the embodiment of the present invention will be explained.

As shown in FIGS. 2 and 4 (incidentally, in FIG. 2, the striker is not shown in the figure), in a state wherein the striker 88 is not locked in the latch 90, due to the coil spring 52, the slider 16 is urged in the direction protruding from the housing 12, and the engagement pins 46B of the lever 46 are positioned in an introduction portion 66A of the cam groove 66.

Here, since a movement of the slider 16 is controlled through the insertion hole (not shown in the figures) provided in the housing 12 and the projection 16A provided in the slider 16, due to an urging force of the coil spring 52, the slider 16 never slips out of the housing 12. Also, in this state, the contact portions 74A of the movable terminals 74 provided in the spring terminal 70 contact the contact portions 54A of the fixed terminals 54 provided in the terminal base 14. Namely, the micro switch is turned ON.

Figure 5:
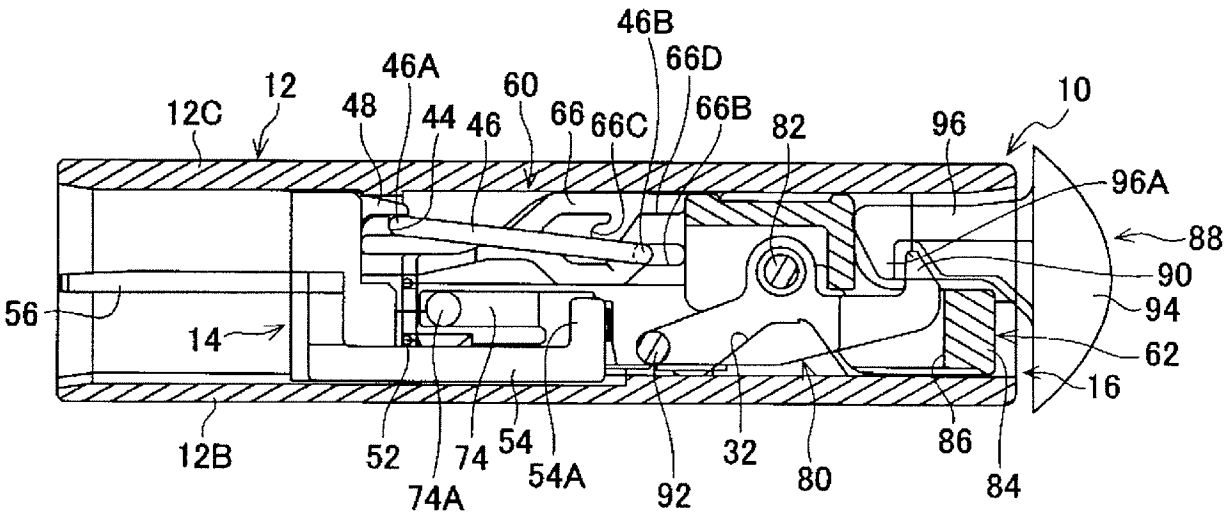
FIG. 5 is a longitudinal cross-sectional view of the switch device according to the embodiment of the present invention, and shows a mid-flow state wherein the striker is locked in the switch device.

From this state, as shown in FIG. 5, the striker 88 is moved to a housing 12 side. Here, the striker 88 includes a button portion 94 whose surface forms a curved surface shape, and from an upper portion of a reverse face of the button portion 94, i.e., a position capable of facing an end face of an upper portion of the supporting portion 62 face-to-face, a locked piece 96 protrudes. A hook-like locked portion 96A provided in an end portion of the locked piece 96 is allowed to be locked in the latch 90 of the latch member 80.

First, from a state shown in FIG. 4, the button portion 94 is pressed so as to move the striker 88 to the housing 12 side. However, the locked portion 96A of the striker 88 abuts against the end face of the upper portion of the supporting portion 62. Consequently, with this state, when the striker 88 is moved to the housing 12 side, the slider 16 is pushed into the housing 12 against the urging force of the coil spring 52 through the supporting portion 62.

As shown in FIG. 5, when the slider 16 is pushed into the housing 12, through the guide portions 92 provided in the slider 16 and the cam slope faces 32 provided in the housing 12, the latch 90 moves upward. At this time, with a movement of the cam groove 66 of the slider 16, the engagement pins 46B of the lever 46 sway along a shape of the cam groove 66.

Here, a first termination portion 66B extends along the longitudinal direction of the slider 16 from the cam groove 66, and when the first termination portion 66B abuts against the engagement pins 46B of the lever 46, the movement of the striker 88 is controlled through the slider 16.

Figure 6:
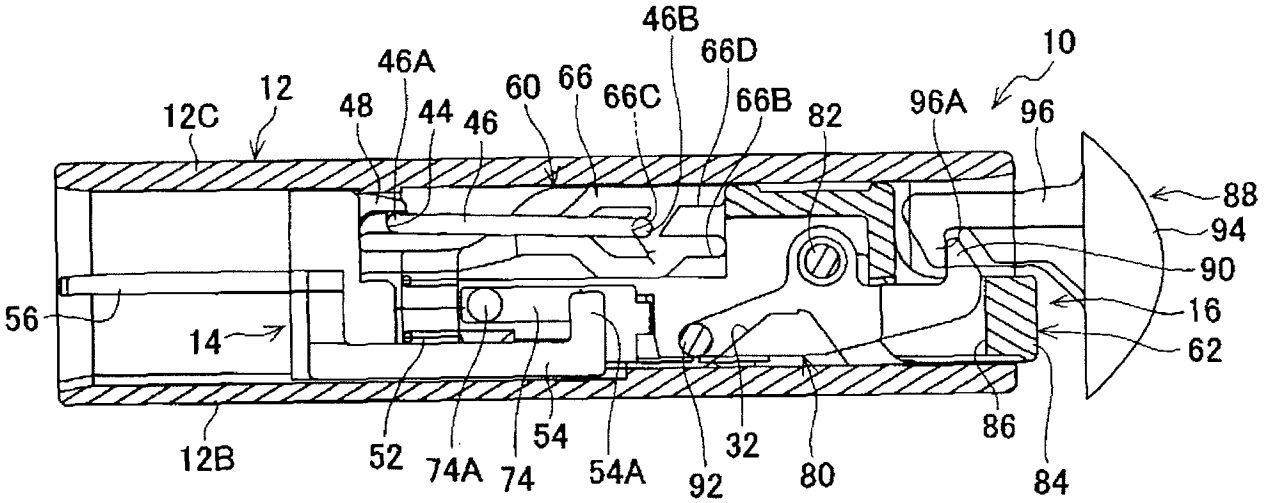
FIG. 6 is a longitudinal cross-sectional view of the switch device according to the embodiment of the present invention, and shows a state wherein the striker is locked in the switch device.

Thereby, when a pressing force to the button portion 94 is released, due to the urging force of the coil spring 52, the slider 16 is urged in the direction protruding from the housing 12. At this time, with the movement of the cam groove 66, as shown in FIG. 6, a depressed portion (locking portion) 66C of the cam groove 66 is locked in the engagement pins 46B of the lever 46 so that the movement of the slider 16 is controlled. Also, the locked portion 96A is locked in the latch 90.

Figure 7:
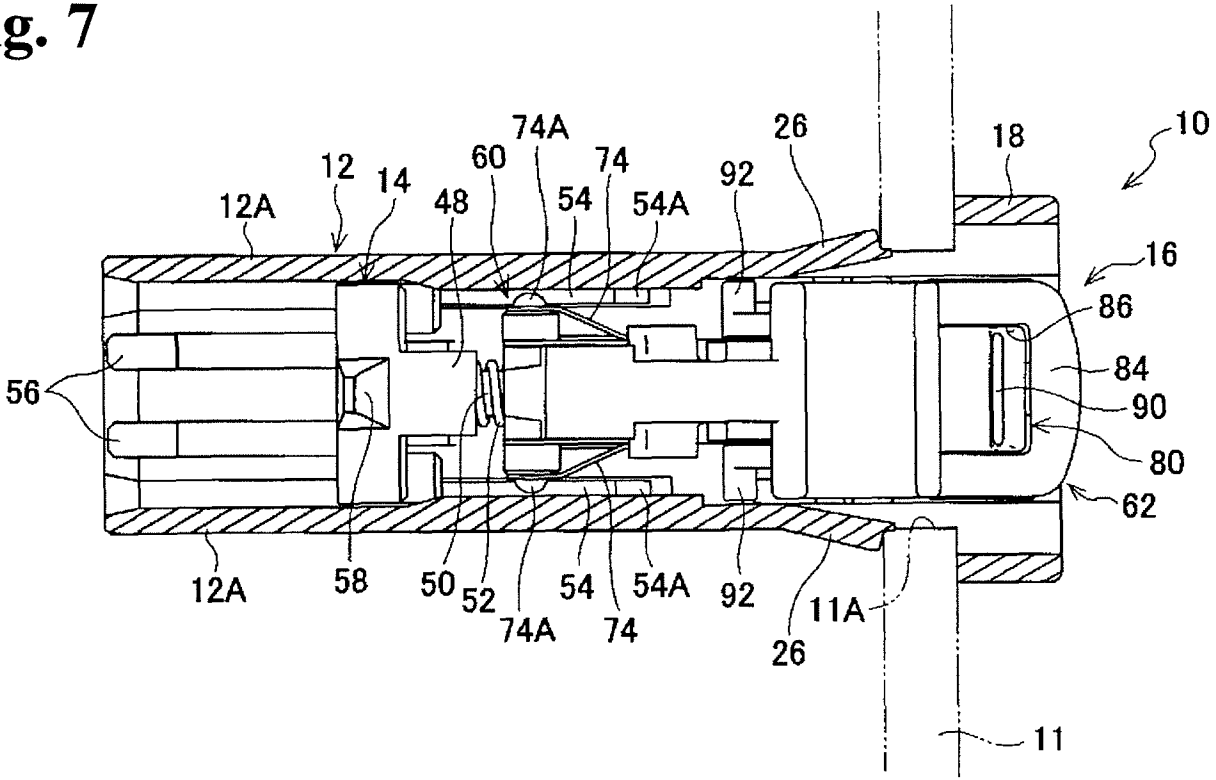
FIG. 7 is a transverse cross-sectional view of the switch device according to the embodiment of the present invention, and shows only the switch device in a state wherein the striker is locked in the switch device.

Then, in a state shown in FIGS. 6 and 7 (incidentally, in FIG. 7, the striker is not shown in the figure), the contact portions 74A of the movable terminals 74 provided in the spring terminal 70 are out of alignment from the face-to-face position with the contact portions 54A of the fixed terminals 54 provided in the terminal base 14, and the contact portions 74A and the contact portions 54A come to the state of not contacting. Namely, the micro switch is turned OFF.

With this state, when the button portion 94 of the striker 88 is pressed again, and the slider 16 is pushed into the housing 12, with the movement of the cam groove 66, a lock state between the depressed portion 66C of the cam groove 66 and the engagement pins 46B of the lever 46 is released, and a second termination portion 66D provided in an upper portion of the first termination portion 66B abuts against the engagement pins 46B of the lever 46, so that the movement of the striker 88 is controlled through the slider 16.

Thereby, when the pressing force to the button portion 94 is released, due to the urging force of the coil spring 52, the slider 16 is urged in the direction protruding from the housing 12. At this time, with the movement of the cam groove 66, as shown in FIG. 4, the introduction portion 66A of the cam groove 66 returns to positions of the engagement pins 46B of the lever 46. Also, the guide portions (cam mechanisms) 92 of the slider 16 move along the cam slope faces 32, so that the latch 90 moves downward. Thereby, a state wherein the locked portion 96A is locked in the latch 90 is released.

Then, in this state, the contact portions 74A of the movable terminals 74 provided in the spring terminal 70 contact the contact portions 54A of the fixed terminals 54 provided in the terminal base 14, so that the micro switch is turned ON.

In the present embodiment, the movable terminals 74 are folded outwardly, and include the leaf spring function. Further, in end portions of the movable terminals 74, the hemispherical contact portions 74A protrude outwardly, and the contact portions 74A contact the contact portions 54A of the fixed terminals 54 provided in the terminal base 14. Then, in the state wherein the contact portions 74A contact the contact portions 54A, the switch is turned ON.

Namely, in a state wherein elastic energy is accumulated in the movable terminals 74, the fixed terminals 54 are contacted. Consequently, compared to a case where only the movable terminals 74 and the fixed terminals 54 are contacted, a contact force between the movable terminals 74 and the fixed terminals 54 improves, and the movable terminals 74 and the fixed terminals 54 can be reliably contacted (conducted).

Incidentally, here, in a state contacting the fixed terminals 54, the elastic energy is accumulated in the movable terminals 74. However, the elastic energy may be accumulated on a fixed terminals 54 side. Also, the elastic energy may be accumulated in the movable terminals 74 and the fixed terminals 54.

However, in the present embodiment, in the state shown in FIGS. 6 and 7, the button portion 94 of the striker 88 is pressed, the slider 16 is pushed into the housing 12, the lock state between the depressed portion 66C of the cam groove 66 and the engagement pins 46B of the lever 46 is released, and due to the coil spring 52, the slider 16 is protruded from the housing 12. Accordingly, the latch member 80 is swayed, and unlocked from the locked piece 96. However, the slider 16 does not always have to be pushed into the housing 12.

Figure 8:
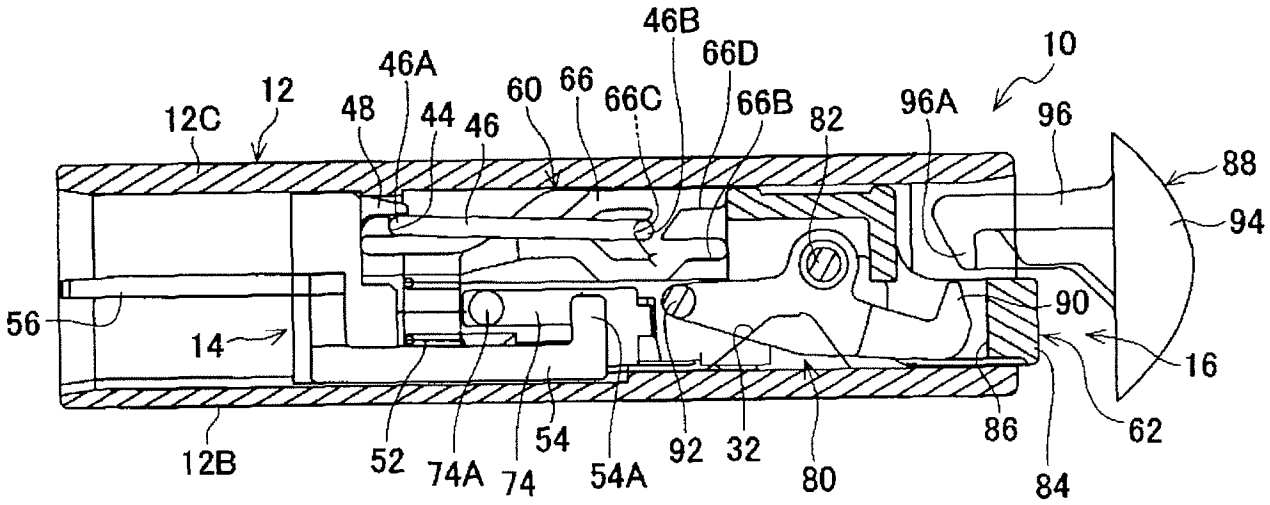
FIG. 8 is a longitudinal cross-sectional view of the switch device according to the embodiment of the present invention, and shows a state wherein the striker is forcedly pulled from the switch device.

Since the latch member 80 is provided so as to be capable of swaying relative to the supporting portion 62, in the state shown in FIGS. 6 and 7, when the striker 88 is pulled, through the locked piece 96 of the striker 88, the latch member 80 sways relative to the supporting portion 62. Consequently, as shown in FIG. 8, the latch 90 can be unlocked from the locked piece 96. Here, in a case where an external force acts between the striker 88 and the latch member 80 more than necessary, a damage of the locked piece 96 and the latch 90 can be prevented.

Also, in the present embodiment, as shown in FIG. 4, in the state wherein the striker 88 is not locked in the latch 90, the contact portions 74A of the movable terminals 74 of the spring terminal 70 are contacted with the contact portions 54A of the fixed terminals 54 of the terminal base 14, so that the switch is turned ON. However, by changing positions of the contact portions 74A of the movable terminals 74 of the spring terminal 70, the switch may be turned OFF in the state wherein the striker 88 is not locked in the latch 90, and the switch may be turned ON in a state wherein the striker 88 is locked in the latch 90.

Also, here, the lever 46 is attached to the stopper 38. However, this is not limited to the above provided that the movement of the slider 16 can be controlled. For example, the lever 46 may be attached to the housing 12. Furthermore, a shape of the striker 88 is not limited to that including the button portion 94. For example, the striker may have a shape provided with the locked piece on a reverse face of a plate-like lid body. Also, depending on the shape of the striker, a shape of the latch 90 may be changed.

What is claimed is:

1. A switch device, comprising:

a moving member provided so as to be capable of protruding from a housing;

a latch member rotatably supported in the moving member, and engaging a striker;

an urging member urging the moving member in a direction protruding from the housing;

a lock mechanism locking the moving member relative to the housing so as to be incapable of moving in a state wherein an urging force is accumulated in the urging member, and releasing a lock state of the moving member when the moving member is pushed into the housing in a state wherein the moving member is locked in the housing;

a cam mechanism provided inside the housing for allowing a movement amount of the moving member to be converted to a rotational force of the latch member;

a movable terminal provided in the moving member; and a fixed terminal provided in a fixed member fixed inside the housing, wherein the movable terminal is contacted and conducted in the lock state of the moving member, and wherein the movable terminal is not contacted and is not conducted in an unlock state of the moving member, and wherein in a state wherein elastic energy is accumulated at least in the movable terminal or the fixed terminal, the movable terminal and the fixed terminal are contacted.

2. A switch device according to claim 1, wherein a fixation mechanism fixing the fixed member is provided in the housing.

3. A switch device according to claim 2, wherein the fixation mechanism comprises an opening provided in the housing, and a projection portion provided in the fixed member, entered into the opening, and locked in an opening border portion of the opening.

4. A switch device according to claim 1, wherein the lock mechanism comprises a circulation cam groove formed in the moving member, and a guide member provided in the housing so as to be capable of swaying, circulating along the circulation cam groove, and locking the moving member in a state locked in a locking portion provided in the circulation cam groove.

5. A switch device according to claim 1, wherein the lock mechanism comprises a circulation cam groove formed in the housing, and a guide member provided in the moving member so as to be capable of swaying, circulating along the circulation cam groove, and locking the moving member in a state locked in a locking portion provided in the circulation cam groove.

6. A switch device according to claim 1, wherein the fixed terminal is formed in the fixed member by insert molding.

7. A switch device, comprising:

a moving member provided so as to be capable of protruding from a housing;

a latch member rotatably supported in the moving member, and engaging a striker;

an urging member urging the moving member in a direction protruding from the housing;

a lock mechanism locking the moving member relative to the housing so as to be incapable of moving in a state wherein an urging force is accumulated in the urging member, and releasing a lock state of the moving member when the moving member is pushed into the housing in a state wherein the moving member is locked in the housing;

a cam mechanism provided inside the housing for allowing a movement amount of the moving member to be converted to a rotational force of the latch member;

a movable terminal provided in the moving member;

a fixed terminal provided in a fixed member fixed inside the housing; and a fixation mechanism provided in the housing and fixing the fixed member, wherein the movable terminal is contacted and conducted in the unlock state of the moving member, and wherein the movable terminal is not contacted and is not conducted in the lock state of the moving member, and wherein in a state wherein elastic energy is accumulated at least in the movable terminal or the fixed terminal, the movable terminal and the fixed terminal are contacted.

8. A switch device according to claim 7, wherein the fixation mechanism comprises an opening provided in the housing, and a projection portion provided in the fixed member, entered into the opening, and locked in an opening border portion of the opening.

9. A switch device according to claim 7, wherein the lock mechanism comprises a circulation cam groove formed in the moving member, and a guide member provided in the housing so as to be capable of swaying, circulating along the circulation cam groove, and locking the moving member in a state locked in a locking portion provided in the circulation cam groove.

10. A switch device according to claim 7, wherein the lock mechanism comprises a circulation cam groove formed in the housing, and a guide member provided in the moving member so as to be capable of swaying, circulating along the circulation cam groove, and locking the moving member in a state locked in a locking portion provided in the circulation cam groove.

11. A switch device according to claim 7, wherein the fixed terminal is formed in the fixed member by insert molding.

* * * * *